US005787833A

United States Patent [19]

Lewis

[11] Patent Number: 5,787,833

[45] Date of Patent: Aug. 4, 1998

[54] AUTOMATIC BLOWER DEVICE FOR CLEARING FUMES FROM A BOAT'S ENGINE COMPARTMENT

[76] Inventor: Loruen Lewis, P.O. Box 70, Kanosh, Utah 84637

[21] Appl. No.: 756,718

[22] Filed: Nov. 26, 1996

[51] Int. Cl.[6] ..... B63J 2/00

[52] U.S. Cl. ..... 114/211; 114/183 R

[58] Field of Search ..... 114/211, 212, 114/183 R, 183 A

[56] References Cited

U.S. PATENT DOCUMENTS

| | | | |
|---|---|---|---|
| 3,652,868 | 3/1972 | Hunt . | |
| 4,134,112 | 1/1979 | Kercheval et al. . | |
| 4,235,181 | 11/1980 | Stickney . | |
| 4,837,570 | 6/1989 | Molfetta et al. | 114/211 |
| 4,991,532 | 2/1991 | Locke . | |
| 5,003,906 | 4/1991 | Sova . | |
| 5,050,520 | 9/1991 | Ballard . | |
| 5,069,152 | 12/1991 | Carter . | |
| 5,357,247 | 10/1994 | Marnel et al. | 114/183 R |
| 5,381,141 | 1/1995 | Stahl . | |
| 5,419,271 | 5/1995 | Tweet et al. | 114/183 R |

*Primary Examiner*—Stephen Avila
*Attorney, Agent, or Firm*—Thorpe North and Western, L.L.P.

[57] ABSTRACT

A method and apparatus for clearing fumes from an engine compartment by providing a pressure switch which is activated when a pressure sensor responds to increased pressure when a boat is at rest or traveling at a wakeless speed in water. When the electrical system of the boat is activated and an inlet tube at the rear of the boat is below the surface of the water, water is able to rapidly enter the inlet tube. Pressure is generated by the presence of water within the inlet tube. Closing the pressure switch results in electrical energy being coupled to the bilge blower to thereby clear the fumes from the engine compartment.

In contrast, when the boat increases its speed to the point where it is planing, the boat is virtually skimming along the surface of the water. Consequently, the inlet tube at the rear end of the boat comes at least partially out of the water, allowing the water within the inlet tube to eventually drain and thus decrease pressure on the pressure sensor which causes the pressure switch to be opened. The electrical power is consequently removed from the blower and it is deactivated.

43 Claims, 5 Drawing Sheets

AUTOMATIC BLOWER DEVICE FOR CLEARING FUMES FROM A BOAT'S ENGINE COMPARTMENT

BACKGROUND OF THE INVENTION

1. Field of the Invention

This invention pertains to a safety device for water craft. More specifically, it pertains to a system and method for automatically clearing fumes from a boat's engine compartment when the boat is not traveling rapidly enough to otherwise prevent the accumulation of toxic and explosive fumes.

2. State of the Art

Water craft are an increasingly popular diversion for many people. As the number of boaters increases, safety concerns become particularly important. These concerns, however, are not only due o the inexperience of many boaters. Even the experienced can become distracted by increased traffic on overburdened lakes, rivers and other waterways. Consequently, many safety devices which must be operated manually can be forgotten.

One safety feature required on all boats is a device for mechanically clearing an engine compartment of dangerous fumes. The fumes are dangerous not only because they are noxious, but they can also result in catastrophic explosions. There have been various attempts at educating boaters of the dangers of fumes, but constant reminders are only effective to a certain degree. The boater who honestly forgets safety procedures or the boater who might intentionally disregard them are not going to be protected from potentially fatal accidents if the fume clearing device is not activated.

The optimal solution for making sure that fumes are cleared from an engine compartment is a device and method of operation of that device which is activated automatically and at the proper times. In other words, an automatic device and method are preferred over a manual method requiring action.

However, even automatic systems for clearing fumes have potential problems. For example, an automatic system is only as good as the components of which it is comprised. In other words, complicated systems or systems which are relatively fragile are inherently less reliable than simpler or more robust systems. A false sense of security can be deadly if the system has failed. It would be advantageous to have a system and method of operation thereof for clearing fumes from an engine compartment which is simple yet reliable.

Systems in the prior art teach various solutions for clearing fumes. For example, in Sova, U.S. Pat. No. 5,003,906, a device is taught which includes a speedometer comprised of a tube which extends beneath the boat and to the rear for allowing water to enter therein. A pressure sensitive gauge can then determine the speed of the boat through the water. A normally closed switch at a measurement of no pressure is responsive to a measurement of a pre-determined pressure level corresponding to a selectable speed. In the normally closed switch position, a blower switch is activated to clear fumes from the engine compartment, regardless of the position of a manual blower switch.

Another system is taught by Carter, U.S. Pat. No. 5,069,154, which uses a plurality of engine pressure measurements at an intake manifold. Another sensor is coupled to the engine to monitor oil pressure. Intake pressure at the manifold, combined with engine oil pressure are indicative of a particular engine speed and corresponding speed of the boat. A preselected speed will then activate a blower to clear fumes from the engine compartment. The system also includes heat and vapor sensors within the engine compartment which can trigger audio and visual alarms for dangerous fume accumulations.

Locke, U.S. Pat. No. 4,991,532, teaches an electronic circuit which is responsive to engine ignition circuit pulses. When a rate of pulses received from the circuit fall below a predetermined rate, the ventilation fan (blower) is automatically activated. The system also provides a temperature controlled blower switch which activates the blower until the engine temperature reaches a certain level.

Other systems such as Kercheval et al. teach a vapor sensing system which only enables the engine to be started if vapors within the compartment are below a predetermined threshold.

These systems are unnecessarily complicated in that they are easily prone to mechanical failure, and are comprised of relatively expensive components which make can substantially raise the costs of protection from fumes. Therefore, it would be advantageous to provide a less complicated and less expensive system than those described in the state of the art.

OBJECTS AND SUMMARY OF THE INVENTION

It is an object of the present invention to provide a method and apparatus for automatically clearing fumes from an engine compartment.

It is another object to provide the method and apparatus above which has increased reliability at reduced cost.

It is still yet another object to accomplish increased reliability by providing a system which is less complex than the state of the art.

It is yet another object to provide a method and apparatus for activating a blower as an indirect consequence of when the boat decreases speed from a water planing speed to a wakeless speed, and deactivating the blower when the boat increases speed from a wakeless speed to a planing speed.

It is a further object to provide a system which enables water to enter into a pressure sensitive system when the boat is traveling at a wakeless speed, and to exit from the system when the boat is traveling at a water planing speed.

It is still a further object to provide a system in which the pressure sensitive system causes the blower to be activated when water causes an increase in pressure in the pressure sensitive system, and to be deactivated when the water exits the pressure sensitive system and thereby causes a decrease in pressure.

It is still yet another object to provide a method and apparatus for remotely activating a blower.

In accordance with these and other objects of the present invention, the advantages of the invention will become more fully apparent from the description and claims which follow, or may be learned by the practice of the invention.

The present invention provides a method and apparatus for clearing fumes from an engine compartment by providing a pressure sensitive switch which is activated when the boat is at rest or traveling at a wakeless speed which will not otherwise clear fumes, and which is deactivated when the boat is traveling at a planing speed. The speed of the boat determines whether water is able to flow into an inlet tube at the rear of the boat because the inlet tube will either be submerged or out of the water depending upon whether the boat is planing. When the electrical system of the boat is activated and the inlet tube is below the surface of the water such as when it is stopped, idling, or traveling at wakeless speeds, the level of the water in the inlet tube is high. Water is then able to enter the inlet tube and cause an increase in pressure. A pressure sensitive sensor coupled to the inlet tube is actuated at a pre-determined pressure setting. Actuation causes a normally open pressure sensitive blower switch to close, resulting in a blower being activated in response to the high water level causing increased pressure on the sensor. Blower activation enables the fumes to be cleared from the engine compartment.

In contrast, when the boat increases its speed to the point where it is planing, the boat is virtually skimming along the surface of the water. Consequently, the inlet tube at the rear end of the boat comes at least partially out of the water, allowing the water within the inlet tube to slowly but eventually drain and thus decrease pressure on the sensor. The closed pressure sensitive switch then returns to its normally open position. Electrical power is thus removed from the blower and it is deactivated.

When the boat decreases to a wakeless speed, the water reenters the inlet tube so that the blower switch is again caused to close, and thereby reactivate the blower to clear fumes.

In another aspect of the invention, an indicator light is provided to indicate to those in the boat when the blower system is running, regardless of whether it is manually, automatically or remotely activated.

In another aspect of the invention, a remote activation system is provided so that the blower can be activated by a remote signal which then causes the blower to clear fumes from the engine compartment.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Before describing the invention, it should be understood that switches are comprised of at least one mechanically movable member which is pivoted to electrically connect at least two contacts. Therefore, any references to closed switches should be understood to mean that electrical power passes between at least two contacts.

Figure 1:
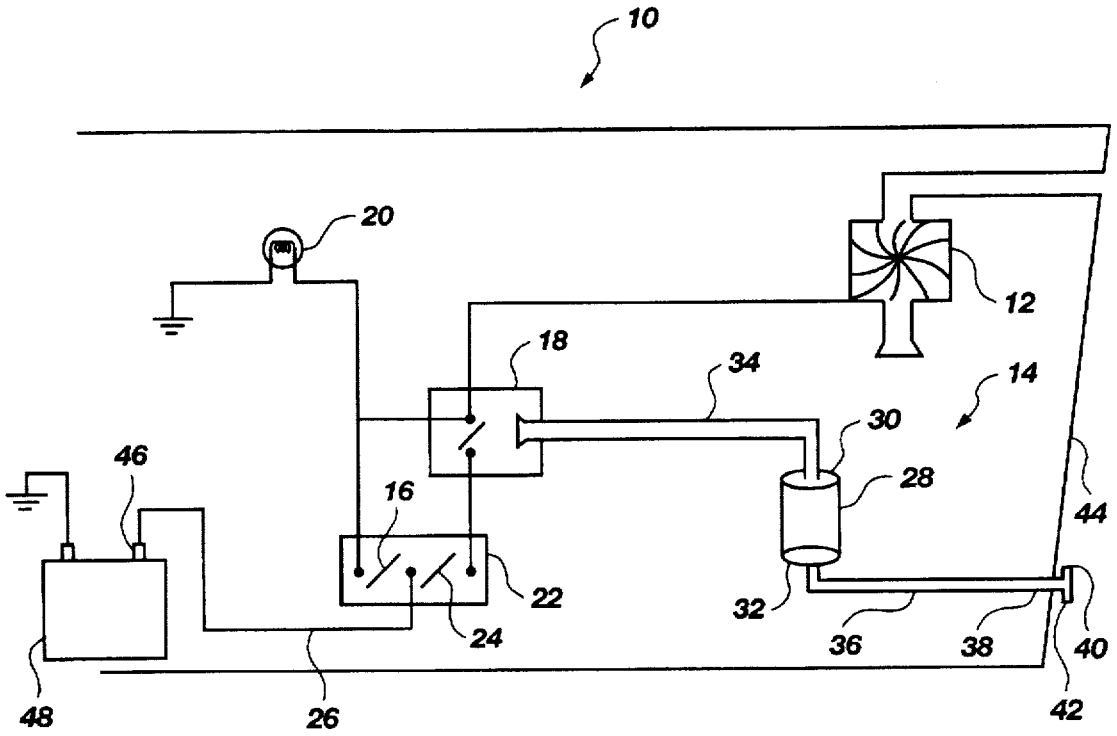
FIG. 1 is schematic diagram showing the components of a preferred embodiment of the present invention.

The present invention is illustrated in a schematic diagram form in FIG. 1. The partial profile outline of a boat 10 is shown generally relative to the mechanical and electrical components of the present invention. The system includes a bilge blower 12 for evacuating the engine compartment 14 of the boat 10. The bilge blower 12 can be activated by a single-pole, double-throw, center-off, toggle switch assembly 22 which is set in what is to be referred to as the manual switch setting 16 (or a triggered or activated manual switch 16) which causes the system to operate regardless of the automatic system described herein. When the manual switch 16 is activated, an indicator light 20 is also lit to provide a visual way of informing the boat operator that the bilge blower 12 is manually activated. However, a different switch setting of the toggle switch assembly 22, in cooperation with a normally open (N/O) switch 18, is also able to supply electrical power to the bilge blower 12 under certain circumstances to be described in more detail later.

The single-pole, double-throw, center-off, toggle switch assembly 22 includes an automatic switch setting 24 which is exclusive of the manual switch setting 16. This means that the system is exclusively in a manual mode or an automatic mode, where the manual mode can override the automatic mode. It should be noted that the center-off position of the toggle switch assembly 22 is electrically coupled to a positive terminal 46 on a power supply, shown here as a battery 48 within the boat 10.

The N/O pressure switch 18 can be described as a water/air column pressure activated switch because it opens and closes relative to pressure from the water and air therein. Therefore, the N/O pressure switch 18 includes a pressure sensor which causes the N/O pressure switch 18 to close in response to a predetermined amount of air pressure thereon. The N/O pressure switch 18 is coupled by tubing 34 to a top end 30 of an air cylinder 28. An opposing bottom end 32 of the air cylinder 28 is coupled to a water access tubing 36. The water access tubing 36 is sent through a watertight and narrow hole 38 in the boat 10 and is secured to the outside of the boat 10. In the preferred embodiment, a check valve 40 and a needle valve 42 are then coupled to the end of the water access tubing 36 to control the flow of water into and out of said tubing 36.

In this preferred embodiment of the automatic bilge blowing system described herein, it will be appreciated that there is a preferred method of operation. Beginning when the boat is still out of the water and being prepared for use, the toggle switch assembly 22 is placed in the manual switch setting by activating the manual switch 16. The indicator light 20 is preferably mounted in a dashboard (not shown) of the boat 10 and lit to indicate that the bilge blower 12 is being operated. The bilge blower 12 is operated to remove any dangerous accumulation of fumes in the engine compartment 14.

When the boat 10 is placed in the water, the toggle switch assembly 22 is then advantageously switched in the preferred embodiment to the automatic switch setting 24. The events which then occur are subject to the placement of the components of the system and their electrical and mechanical interconnections. Beginning with the flow of water into the water access tubing 36, it will be appreciated that a check valve 40 accomplishes this function by operating as a one-way inlet port for water. It will be appreciate by those skilled in the art that there are numerous valves which may permit the rapid entry of water thereinto, which also prevent water from passing backward through the entry valve. These valves should also be considered as workable replacements for the check valve described herein.

It is desired that water enter the check valve 40 when the boat 10 is at rest or traveling at wakeless speeds. Therefore, the check valve 40 must be lower than the water level relative to the boat when the boat is at rest. However, for the water to drain from the needle valve 42 when the boat has accelerated sufficiently so that it is planing, the check valve 40 and needle valve 42 must then be disposed above the water level. One skilled in the art will appreciate that the specific placement of the valves 40 and 42 is not difficult to ascertain by simply observing a point on the outer aft wall 44 of the boat 10 which is below water at rest or wakeless speeds, and above the water when the boat 10 is planing.

In the preferred embodiment, another factor concerning placement of the valves 40 and 42 is the requirement that the bottom end 32 of the air cylinder 28 must be above the valves 40 and 42. Those skilled in the art will appreciate that this positional relationship is required if water is to drain from the air cylinder 28 when the boat 10 is planing. As a practical matter, it is likely to be easier to position the air cylinder 28 within the boat 10 if the valves 40 and 42 are placed as low on the outer aft wall 44 as possible such that water will drain when the boat 10 is planing. In the preferred embodiment, the air cylinder 28 is inside the boat 10. The water access tubing 36 provides a conduit for water to enter the air cylinder 28, as well as drain from it.

Figure 2:
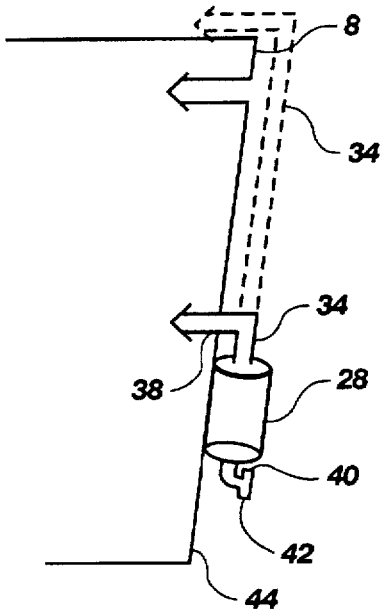
FIG. 2 is an alternative embodiment of the components shown in FIG. 1.

Those skilled in the art will appreciate that in an alternative embodiment shown in FIG. 2, the valves 40 and 42 can be coupled directly to the bottom end 32 of the air cylinder 28. Consequently, one way for water to enter the air cylinder 28 in this alternative embodiment is to mount the air cylinder 28 on the outer aft wall 44 of the boat 10. The tubing 34 coupled to the top end 30 of the air cylinder 28 and could then pass through the narrow and watertight hole 38 into the boat 10. However, those skilled in the art should recognize that in an alternative embodiment, the narrow and watertight hole 38 doesn't have to be made in the boat 10. The tubing 34 can simply go over a railing 8 of the boat 10. The N/O pressure switch 18 could then be placed anywhere within the boat 10 that is convenient for coupling to the tubing 34.

In either the preferred or the alternative embodiments described above, it will be appreciate that an advantage of all embodiments is the placement of the valves 40 and 42 in a location which does not interfere with the normal operation of the boat 10. This is in contrast to the teachings of Sova (5,003,906) which require a pito tube to extend outward from and underneath the boat. Because of the pito tube placement, it can be easily broken off or become clogged with debris which would prevent operation. Furthermore, the pito tube is always under water, and therefore it is more difficult to check its condition. In contrast, the valves 40 and 42 of the present invention are not extended away from the boat 10 in an awkward position such as beneath the boat, and can be easily inspected by visual or tactile means for obstructions which might clog the valves 40 and 42.

A final comment regarding the water access tubing 36 in the preferred embodiment concerns the need to verify that nothing interferes with the flow of water. Therefore, careful installation should include removing excess water access tubing 36 which might sag or otherwise prevent proper water drainage from the air cylinder 28.

As shown in the preferred embodiment of FIG. 1 and the alternative embodiment of FIG. 2, the air cylinder 28 is in an upright position relative to the boat 10 at rest or at wakeless speeds in the water. The slight angle of the air cylinder 28 which occurs during planing will not affect its operation. In the preferred embodiment, the air cylinder 28 is about six inches long and about 2 inches in diameter, and is domed at the top end 30 and the bottom end 32. Those skilled in the art will appreciate, however, that the dimension of the air cylinder 28 can vary significantly from those selected in the preferred embodiment. It is only necessary that the cylinder provide the desired function of trapping air and/or water.

An important factor about placement of the air cylinder 28 is that for proper operation of the system, the top end 30 of the air cylinder 28 must be below the water level when the boat 10 is at rest in the water. The reason for this requirement should become apparent from a consideration of the operation of the system as follows.

Before the boat 10 is placed in the water and while it is being prepared for use, the single-pole, double-throw, center-off, toggle switch assembly 22 should be placed in the manual switch setting 16 to clear fumes from the engine compartment 14. Until the boat is placed in the water, activating the automatic switch setting 24 will not cause the bilge blower 12 to operate because there is insufficient air pressure to activate the N/O pressure switch 18 and cause it to close. After the boat is placed in the water, the boat operator will throw the single-pole, double-throw, center-off, toggle switch assembly 22 to the automatic switch setting 24. The bilge blower 12 should continue to operate or begin to operate almost immediately because of the following sequence of events.

First, the check valve 40 should be below the water level because the boat is at rest. Consequently, water rapidly and immediately begins to enter the check valve 40. The water then passes through the water access tubing 36 and may begin to fill or partially fill the air cylinder 28 from the bottom end 32. It must be remembered that the top end 30 of the air cylinder 28 is below the outside water level outside of the boat 10. In the preferred embodiment, the top end 30 of air cylinder 28 is positioned approximately two inches below the water level. However, this does not mean that the air cylinder 28 will fill completely with water. Although the air cylinder 28 is coupled to a length of tubing 34 at its top end 30, this tubing 34 only leads to the N/O pressure switch 18 which does not provide an exit path for the water. If water could exit, there would be no buildup of air pressure at the N/O pressure switch 18. Therefore, water entering the check valve 40 compresses the air within the water access tubing 36, the air cylinder 28, and through the tubing 34 all the way to the N/O pressure switch 18.

It should be mentioned that the N/O pressure switch 18 is generally capable of adjustment regarding what pressure will cause the N/O pressure switch 18 to be activated. Therefore, while the preferred embodiment of the present invention operates reliably when the top end 30 of the air cylinder 28 is two inches below the outside water level, this relative position of the air cylinder 28 is a result of the sensitivity and pressure settings of a pressure sensor (not shown) within the N/O pressure switch 18.

The air pressure is measured by the pressure sensor (not shown) within the N/O pressure switch 18. When the air pressure is sufficiently high, the N/O pressure switch 18 closes. As seen in FIG. 1, the positive terminal 46 of the battery 48 now supplies electrical power through the automatic switch setting 24 of the single-pole, double-throw, center-off, toggle switch assembly 22, through the closed N/O pressure switch 18, and to the bilge blower 12.

A comment regarding the position of the N/O pressure switch 18 is directed to its relationship to the air cylinder 28. It is not inconceivable that water might somehow get through the air cylinder 28 and into the tubing 34 which is also coupled to the N/O pressure switch 18. Therefore, it is important in the preferred embodiment that for proper operation of the system, the N/O pressure switch 18 should be located above the air cylinder 28. It is equally important that the tubing 34 have a downward slope from the N/O pressure switch 18 to the air cylinder 28 to prevent pooling of water which might affect the pressure reading of the pressure sensor associated with the N/O pressure switch 18.

A distinct advantage of the present invention is that the air pressure will remain relatively constant within the system even if the boat 10 is at rest in rough waters which might expose the needle valve 42. This is because a water restriction orifice such as a needle valve 42 is used at the end of the water access tubing 36 to prevent the rapid escape of the water creating the increased air pressure which is causing the N/O pressure switch 18 to be closed. Therefore, if the boat is at rest in choppy waters which causes the needle valve 42 to be momentarily lifted out of the water, the water will drain slow enough to prevent the closed N/O pressure switch 18 from opening and turning off the bilge blower 12. It should be realized that most if not all significant bumps to the boat 10 which momentarily lift the aft end 44 out of the water will not cause the bilge blower 12 to turn on and off repeatedly. This should serve to reduce wear and tear on components.

It should be observed that any valve-like device which prevents rapid escape of water therethrough can be substituted for the needle valve 42 of the preferred embodiment. For example, the shape of many orifices are such that they can easily restrict the flow of water in a single direction as it is being exhausted out of the water access tubing 36.

When the boat is traveling at wakeless speed such as when leaving a dock or a loading/unloading area, the needle valve 42 remains beneath the surface of the water and so the bilge blower 12 remains on. However, once the boat 10 has left the wakeless speed area, it may accelerate and begin to plane. At these higher speeds, vents in the boat 10 scoop air into the engine compartment and clear fumes. Therefore, the bilge blower 12 becomes redundant. A short time after the boat has reached a speed where it is planing, the bilge blower 12 is turned off when electrical power is cut in response to the N/O pressure switch 18 opening because of decreased air pressure on the pressure sensor. As explained previously, decreased air pressure is a result of the needle valve 42 allowing a sufficient quantity of water to bleed out of the water access tubing 36, because a substantial portion or all of the air cylinder 28 and all of the needle valve 42 are now out of the water.

It should also be apparent to those skilled in the art that just as the check valve 40 can be replaced with an appropriate substitute device which performs the same function, likewise the needle valve 42 can also be replaced.

An important advantage of the present invention over those devices of the prior art which also clear fumes from the engine compartment 14 is in the situations under which the present invention will operate correctly, but the prior art might not. For example, when a boat is slowly cruising at wakeless speed, the boat 10 typically does not have enough speed to force air through vents which otherwise clear fumes at higher speeds. But while the present invention is dependent upon having the check valve submerged in the water, other devices rely on much less dependable means for determining when the bilge blower should be activated. For example, returning again to Sova (5,003,906), the speed sensing system is inherently less reliable because of the more complicated mechanical components, and consequently provides a much less reliable method of determining when the bilge blower 12 should be activated. Likewise, engine speed indicators and vapor sensors are less reliable and also use much more costly components. On the other hand, the pressure sensor in the preferred embodiment is a very inexpensive unit. It is the type of pressure sensor used for water level control within commercial or residential automatic washing machines for clothing. This type of pressure sensor is extremely durable and reliable. For example, a typical air pressure sensor which is used in the preferred embodiment is manufactured by the Singer Control Division. Furthermore, the mass quantities in which they are produced will continue to keep the price very low.

Figure 3:
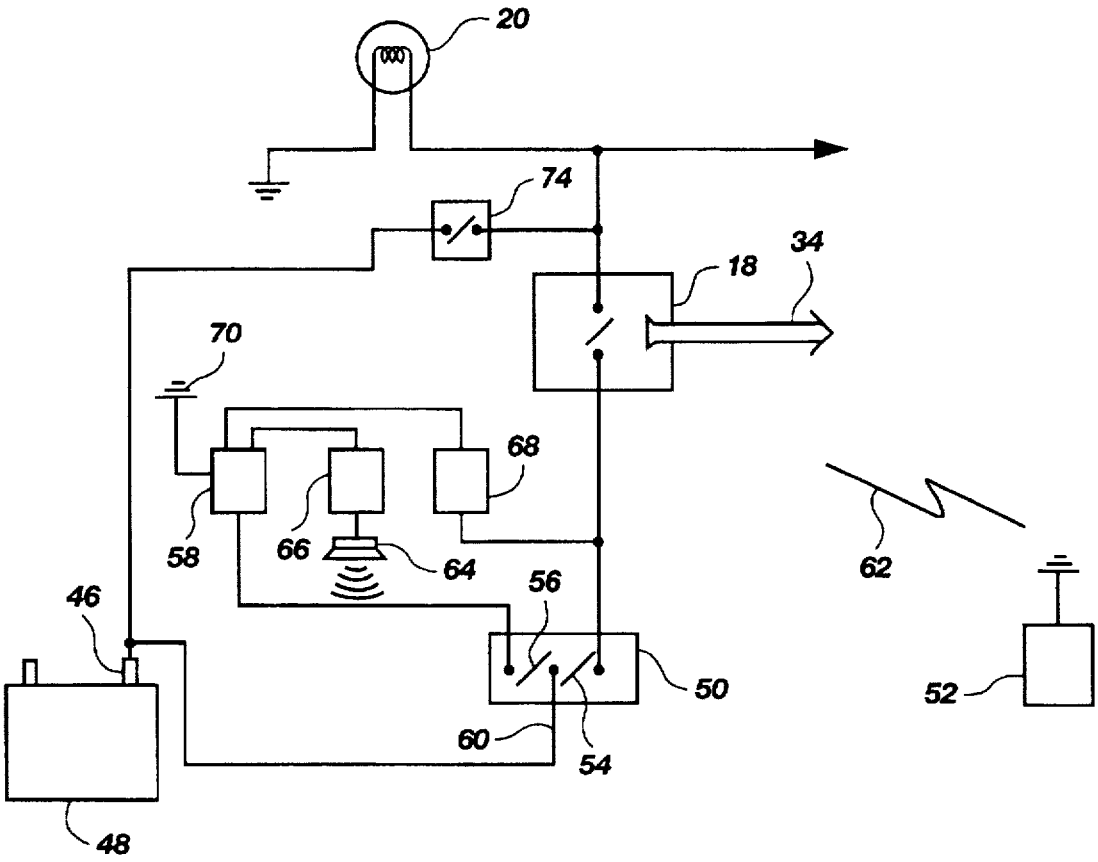
FIG. 3 is a functional block diagram showing a modified FIG. 1 including the additional components required in a preferred embodiment for remotely activating the blower.

FIG. 3 shows how the preferred embodiment shown in FIG. 1 might be modified to enable a remote activation device to allow the bilge blower 12 to be activated when a boat operator is away from the boat 10 or its control panel. Those familiar with boats having enclosed engine compartments recognize the need for running the bilge blower 12 for about four minutes before the engine is started. Having the ability to remotely start the bilge blower 12 at a distance and before boarding the boat 10 adds an extra element of convenience, and more importantly, safety.

In this exemplary illustration, the single-pole, double-throw, center-off, toggle switch assembly 22 is modified to provide different electrical connections. Specifically, the toggle switch assembly 50 is modified to be electrically coupled to the system to thereby activate the bilge blower 12 in response to a signal from a remote signalling device 52. In effect, the remote activation device provides a third way to activate the bilge blower 12.

As shown, the new single-pole, double-throw, center-off, toggle switch assembly 50 can be used to electrically couple the positive terminal 46 of the battery 48 to the bilge blower 12 by a first switch 54. First switch 54 is just the automatic switch setting which has been discussed previously in FIG. 1 as item 24. Its method of operation has not changed. However, a second switch setting 56 is provided so that the bilge blower 12 can now be remotely activated instead of manually activated. As will be explained, throwing switch 56 only enables a remotely activated to be able to activate the bilge blower 12, without actually activating it until a remotely activated system receives a signal.

The electrical connections for the manually activated switch are removed from the single-pole, double-throw, center-off, toggle switch assembly 50 and replaced by a single pole toggle switch assembly 74 which remains electrically coupled as before. In other words, when triggered, it bypasses the automatic switch 54 and the remotely automatic switch 56.

The second switch setting 56 provides an electrical connection between the remote signalling receiver 58 and the power supply 48. This electrical connection is not for providing power for operation of the remote signalling receiver 58, but for the bilge blower 12. The remote signalling receiver 58 therefore is also coupled to two relays, 66 and 68. Relay 66 is a horn relay. The horn relay 66 is coupled to a horn 64 to momentarily provide electrical power to the horn 64 and thereby provide an audible indication to the boat operator that the remote signalling receiver 58 has received an activation/deactivation toggling signal 62 and the bilge blower 12 is being remotely activated. A horn relay 66 is used because it can provide momentary power to an electrical circuit and then shut itself off to remove electrical power from the horn 64.

The remote signalling receiver 58 also conducts electrical power for the bilge blower 12 through a blower relay 68. In practice of the preferred embodiment, the blower relay 68 remains active even if the remotely automatic switch 56 is turned to the center-off position or to the automatic switch position 54. The only way to deactivate relay 68 is to send the appropriate activation/deactivation toggling signal 62. It is therefore envisioned that sending the activation/deactivation toggling signal 62 when the second switch setting 56 is already triggered will serve as a toggling mechanism to open the second switch setting 56 and thus remove the electrical power which is opening the blower relay 66 and supplying electrical power to the bilge blower 12.

Operation of the remote signalling system is as follows. A remote signalling device 52 is activated, typically by pressing and releasing a button on a hand-held unit to thereby transmit the activation/deactivation toggling signal 62, and the activation/deactivation toggling signal 62 is received by the remote signalling receiver 58 at an antenna 70 thereof if the activation/deactivation toggling signal 62 is strong enough to be detected. If detected, the remote signalling receiver 58 activates the blower relay 68. It also enables electrical power to reach the horn relay 66 which momentarily couples the horn 64 to the battery 48. This results in the momentarily audible sound from the horn 64 until the horn relay 66 switches to cut power to the horn 64. Simultaneously as electrical power is being supplied to the horn relay 66, the blower relay 68 is also receiving electrical power. The blower relay 68 closes to provide electrical power to the N/O pressure switch 18. If the N/O pressure switch 18 is open, electrical power is not supplied to the bilge blower 12 despite triggering of the remote activation system.

In this preferred alternative embodiment described above, the remote signalling device 52 transmits a radio frequency activation/deactivation toggling signal 62 to the remote signalling receiver 58. To prevent remote signalling devices 52 from activating all bilge blowers 12 within range of the activation/deactivation toggling signal 62, the activation/deactivation toggling signals 62 are uniquely coded so that only remote signalling receiver 58 associated with a specific remote signally device 52 will recognize the activation/deactivation toggling signal 62 for which it was intended. This signalling and coding scheme is similar to the system commonly used in remote car alarms and remote unlocking/locking car door devices. For various reasons, it is very unlikely that a remote signalling device 52 will activate more than the intended remote signalling receiver 58 because of the numerous unique codes which are used.

Figure 4:
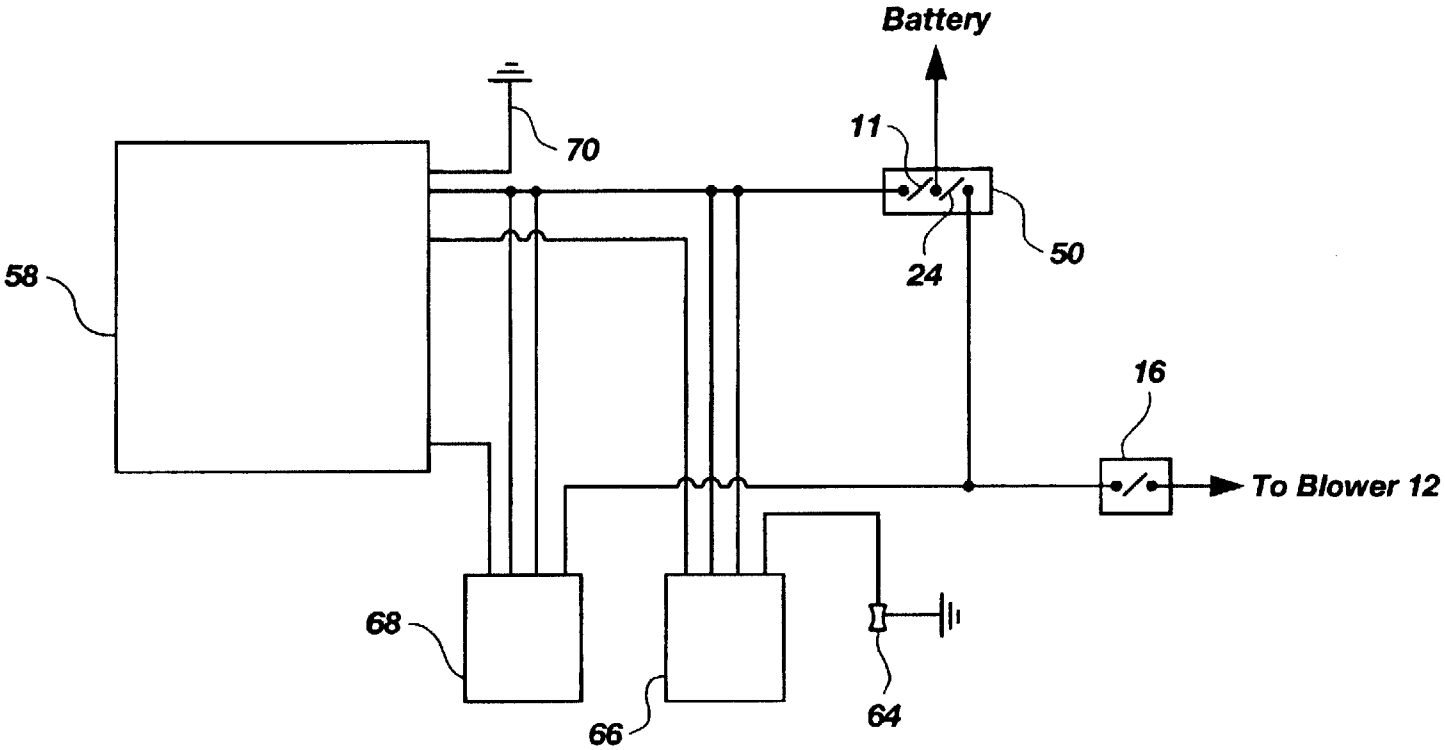
FIG. 4 is a circuit schematic diagram showing more detail of the wiring connections between the additional components of FIG. 3.

FIG. 4 is provided to show more detailed schematics of the remote signalling receiver 58, horn relay 66 and blower relay 68.

Figure 5:
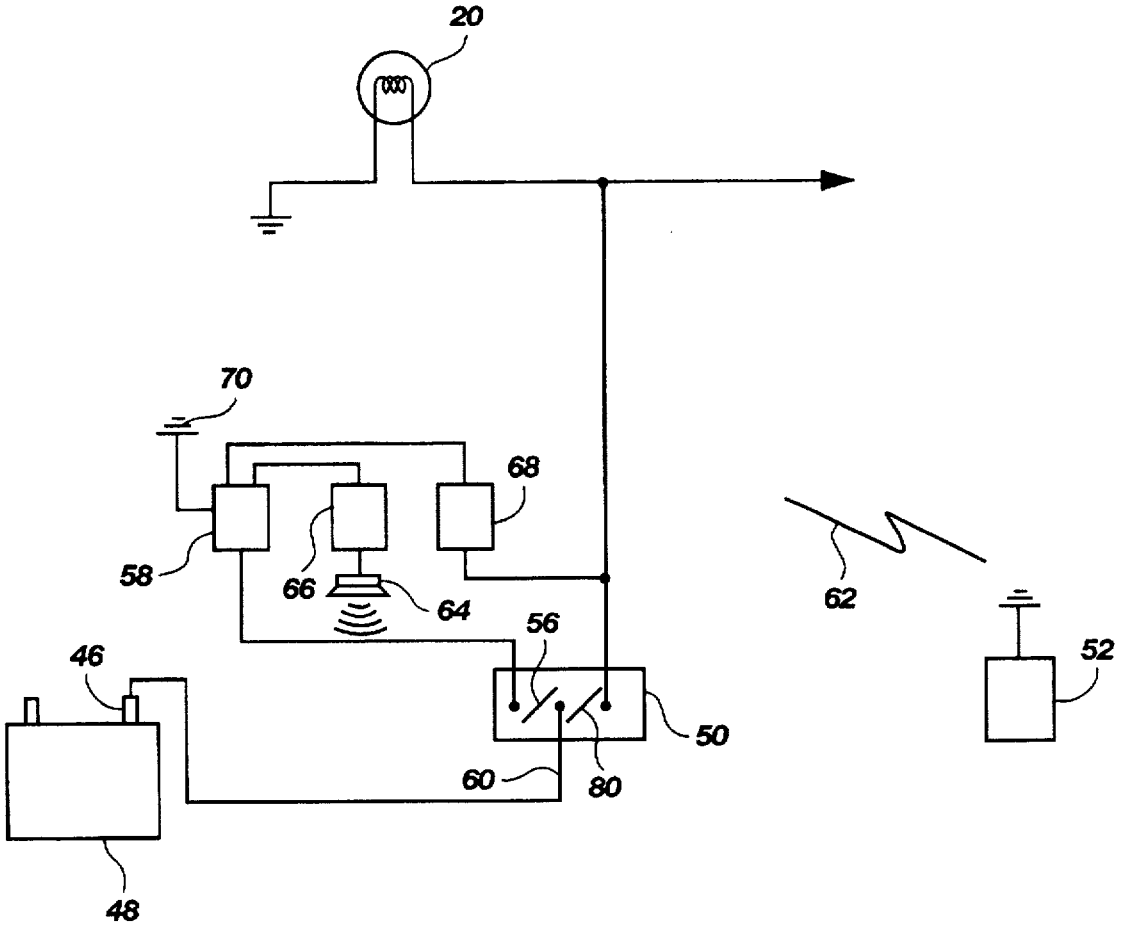
FIG. 5 is a functional and circuit schematic diagram showing an alternative embodiment of the present invention which has both a manually activated switch and a remotely activated switch, but no automatic switch.

An alternative embodiment of the remotely activated system of FIG. 3 is implementation of a remotely activated bilge blower switch along with a manually activated switch as shown in FIG. 5. All circuitry for the automatic blower system of FIG. 3 is removed, as well as the separate manual switch 74. The remaining components enable are combined in the single-pole, double-throw, center-off, toggle switch assembly 50, which enables manual or remote activation of the bilge blower 12.

Specifically, the first switch setting 80 is now the manual switch for the bilge blower 12. Therefore, the second switch setting 56 provides an electrical connection between the remote signalling receiver 58 and the power supply 48. The remote signalling receiver 58 is coupled to two relays, 66 and 68. Relay 66 is still the horn relay. The horn relay 66 is coupled to the horn 64 to momentarily provide electrical power to the horn 64 and thereby provide an audible indication to the boat operator that the remote signalling receiver 58 has received an activation/deactivation toggling signal 62 and the bilge blower 12 is being remotely activated. A horn relay 66 is used because it can provide momentary power to an electrical circuit and then shut itself off to remove electrical power from the horn 64. The remote signalling receiver 58 also activates the blower relay 68. The blower relay 68 closes to provide electrical power to the bilge blower 12.

Figure 6:
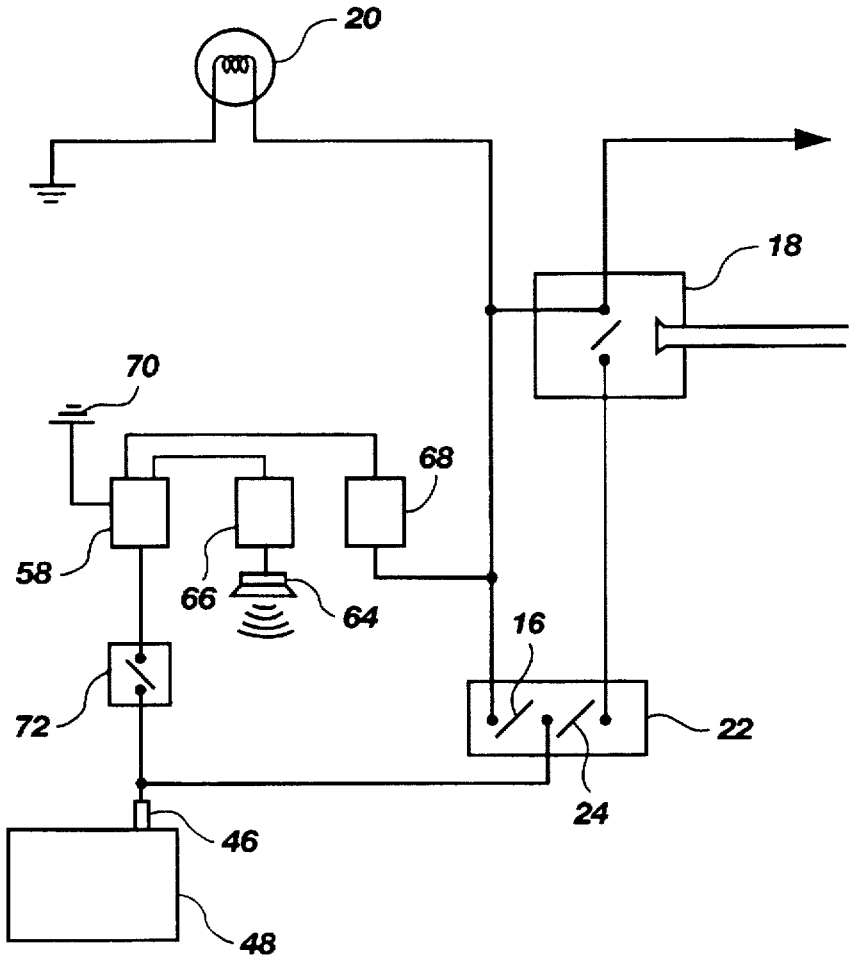
FIG. 6 is a functional block diagram showing a modified FIG. 1 including additional components required in an alternative embodiment for remotely activating the blower.

FIG. 6 is provided as an alternative embodiment of FIG. 1, but which also enables remote activation of the bilge blower 12. One of the advantages of this embodiment over the embodiment of FIGS. 3 and 4 is that the remote activation system components are only added to the existing wiring. For example, the remote signalling receiver 58 now activates switch 72 to remote activate the system and thus provide electrical power to the bilge blower 12. Therefore, if an existing manual bilge blower system is replaced with the system of FIG. 1, it can be upgraded to include the remote bilge blower activation system by simply adding the remote automatic switch 72 and wiring the system as shown.

It is to be understood that the above-described embodiments are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A water craft which includes a system for automatically clearing fumes from an engine compartment when the water craft is at rest or is not traveling rapidly enough through the water to otherwise clear fumes from the engine compartment, said system comprising:

an air pressure sensor coupled to a water inlet outside the water craft to thereby generate an activation signal indicative of the water inlet being disposed beneath the water around the water craft to thereby receive water thereinto and cause an increase in air pressure on the air pressure sensor;

a bilge blower;

a power supply; and a pressure switch electrically disposed between the bilge blower and the power supply and responsive to the activation signal to thereby electrically couple the bilge blower to the power supply so that the bilge blower clears the engine compartment of fumes.

2. The system as defined in claim 1 wherein the water inlet further comprises a check valve for enabling rapid and one way intake of water through said water inlet.

3. The system as defined in claim 2 wherein the system further comprises:

a water access tube coupled at a first end to the check valve;

an air cylinder having a top end and a bottom end, and being coupled at the bottom end to a second end of the water access tube; and an air tube coupled at a first end to the top end of the air cylinder, and coupled at a second end to the air pressure sensor.

4. The system as defined in claim 3 wherein the air cylinder more specifically comprises an airtight tank which is positioned to be elevated above the check valve such that the water access tube follows a downward slope from the air cylinder to the check valve.

5. The system as defined in claim 3 wherein the air pressure sensor is positioned to be elevated above the air cylinder such that the air tube follows a downward slope from the air pressure sensor to the air cylinder.

6. The system as defined in claim 1 wherein the water inlet includes a water outlet for allowing water to escape from inside the water inlet when the water inlet is generally above the water and exposed when the water craft is planing.

7. The system as defined in claim 6 wherein the water outlet is more specifically comprised of a water restriction orifice which inhibits a flow of water out of the water outlet.

8. The system as defined in claim 6 wherein the water outlet is more specifically comprised of a needle valve.

9. The system as defined in claim 1 wherein the power supply is a battery within the water craft, having a positive terminal which is electrically coupled to the bilge blower via the manual switch setting, or via the automatic switch setting when the pressure switch is activated.

10. The system as defined in claim 1 wherein the system further comprises:

a manual switch which activates the bilge blower by electrically coupling the bilge blower and an indicator light to the power supply when engaged; and an automatic switch which electrically couples the pressure switch to the power supply when engaged.

11. The system as defined in claim 10 wherein the manual switch and the automatic switch are included within a single-pole, double-throw, center-off, toggle switch assembly having a manual switch setting and an automatic switch setting.

12. The system as defined in claim 11 wherein the power supply is electrically coupled to the bilge blower via the automatic switch setting only when the pressure switch is activated to electrically couple the bilge blower and the indicator light to the automatic switch setting on the single-pole, double-throw, center-off, toggle switch assembly.

13. The system as defined in claim 12 wherein the activated manual switch also electrically couples the indicator light to the power supply to thereby cause the indicator light to be lit when the bilge blower is in operation, and not to be lit when the toggle switch is in the center off position.

14. The system as defined in claim 13 wherein the activated automatic switch also electrically couples the indicator light to the power supply to thereby cause the indicator light to be lit when the pressure switch is triggered such that the bilge blower is in operation.

15. The system as defined in claim 10 wherein the system further comprises a remote bilge blower activation system for remotely activating the bilge blower to clear fumes from the engine compartment, independent of the manual switch and the automatic switch.

16. The system as defined in claim 15 wherein the system further comprises a remote automatic switch which electrically couples the pressure switch to the power supply when engaged.

17. The system as defined in claim 16 wherein the remote automatic switch and the automatic switch are included within a single-pole, double-throw, center-off, toggle switch assembly having a remote automatic switch setting and an automatic switch setting, and the manual switch is included within a single-pole, single-throw, toggle switch assembly.

18. The system as defined in claim 17 wherein the power supply is electrically coupled to the bilge blower via the automatic switch setting or the remote automatic switch setting only when the pressure switch is activated to electrically couple the bilge blower and the indicator light to the automatic switch setting on the single-pole, double-throw, center-off, toggle switch assembly.

19. The system as defined in claim 18 wherein the activated manual switch also electrically couples the indicator light to the power supply to thereby cause the indicator light to be lit when the bilge blower is in operation, and not to be lit when the toggle switch is in the center off position.

20. The system as defined in claim 19 wherein the activated automatic switch or the activated remote automatic switch also electrically couple the indicator light to the power supply to thereby cause the indicator light to be lit when the pressure switch is engaged, such that the bilge blower is in operation.

21. The system as defined in claim 20 wherein the remote bilge blower activation system is further comprised of a remote signalling transmitter and a remote signalling receiver system, wherein the remote signalling transmitter is located separate from the water craft controls, and the remote signalling receiver system is disposed within the water craft.

22. The system as defined in claim 21 wherein the remote signalling transmitter transmits a radio frequency activation/deactivation toggling signal which is received by the remote signalling receiver system to thereby activate the remote bilge blower activation system.

23. The system as defined in claim 22 wherein the remote signalling transmitter transmits a coded radio frequency activation/deactivation toggling signal which is received and decoded by the remote signalling receiver system to thereby activate the remote automatic switch.

24. The system as defined in claim 22 wherein the remote signalling receiver system is comprised of:

a remote signalling receiver for receiving the radio frequency activation/deactivation toggling signal, and which is electrically coupled to the remote automatic switch for receiving electrical power from the power supply; and a bilge blower relay which is electrically coupled to the remote signalling receiver and the pressure switch for transmitting the electrical power thereto.

25. The system as defined in claim 24 wherein the remote signalling receiver system is further comprised of a horn relay which is electrically coupled to the remote signalling receiver to thereby momentarily couple the electrical power to an activation signalling device in order to generate a momentary audible sound.

26. The system as defined in claim 25 wherein the activation signalling device is more specifically comprised of a horn.

27. A method for clearing fumes from an engine compartment when a water craft is at rest or is not traveling rapidly enough through the water to otherwise clear fumes from the engine compartment, said method comprising the steps of:

1) providing an air pressure sensor coupled to a water inlet outside the water craft to thereby generate an activation signal indicative of the water inlet being disposed beneath the water around the water craft to thereby receive water thereinto and cause an increase in air pressure on an air pressure sensor;

2) providing a bilge blower for blowing fumes from the engine compartment;

3) providing a power supply; and 4) disposing a pressure switch electrically between the bilge blower and the power supply which is responsive to the activation signal to thereby electrically couple the bilge blower to the power supply and thereby activate the bilge blower to clear the engine compartment of fumes.

28. The method as defined in claim 27 wherein the step of providing a water inlet comprises the more specific step of providing a check valve for enabling rapid and one way intake of water through said water inlet.

29. The method as defined in claim 28 wherein the method comprises the more specific steps of:

1) coupling a water access tube at a first end to the check valve;

2) providing an air cylinder having a top end and a bottom end, and coupling the bottom end to a second end of the water access tube; and 3) coupling an air tube at a first end to the top end of the air cylinder, and coupling a second end to the air pressure sensor.

30. The method as defined in claim 29 wherein the step of providing an air cylinder more specifically comprises the steps of:

1) providing an airtight tank; and 2) positioning said airtight tank so as to be elevated above the check valve such that the water access tube follows a downward slope from the air cylinder to the check valve.

31. The method as defined in claim 29 wherein the method comprises the more specific step of positioning the air pressure sensor so as to be elevated above the air cylinder such that the air tube follows a downward slope from the air pressure sensor to the air cylinder.

32. The method as defined in claim 27 wherein the method includes the more specific step of including a water outlet for allowing water to escape from inside the water inlet when the water inlet is exposed while the water craft is planing.

33. The method as defined in claim 32 wherein the method comprises the more specific step of providing a needle valve as the water outlet to thereby restrict a flow of water out of the water outlet.

34. The method as defined in claim 27 wherein the method comprises the more specific step of providing a battery as the power supply within the water craft.

35. The method as defined in claim 27 wherein the method comprises the more specific steps of:

1) providing a manual switch for forcing activation of the bilge blower; and 2) providing an automatic switch for enabling the bilge blower to be activated whenever the pressure sensor generates the activation signal.

36. The method as defined in claim 35 wherein the method includes the additional step of activating an indicator light on a control panel of the water craft whenever the bilge blower is activated.

37. The method as defined in claim 35 wherein the method comprises the additional step of providing a remote bilge blower activation system for remotely activating the bilge blower to clear fumes from the engine compartment, and which is independent of the manual switch and the automatic switch.

38. The method as defined in claim 37 wherein the step of providing a remote bilge blower activation system is comprised of the more specific steps of:

a) providing a remote signalling transmitter external to controls of the water craft;

b) providing a remote signalling receiver system within the water craft for receiving an activation/deactivation toggling signal and coupling electrical power to the bilge blower; and c) activating the remote signaling transmitter to thereby generate the activation/deactivation toggling signal.

39. The method as defined in claim 38 wherein the method comprises the more specific step of transmitting and receiving a radio frequency activation/deactivation toggling signal to thereby generate the activation signal and activate the bilge blower.

40. The method as defined in claim 39 wherein the method comprises the more specific step of transmitting a coded radio frequency activation/deactivation toggling signal which is received and decoded by the remote signalling receiver system to thereby activate the bilge blower.

41. The method as defined in claim 38 wherein the step of providing the remote activation system is comprised of the more specific steps of:

1) providing an audible alarm relay for momentarily activating an audible alarm to indicate that the remote activation system is engaged; and 2) providing a bilge blower relay which is activated by the remote signalling receiver channeling electrical power to the bilge blower relay in response to the activation/deactivation toggling signal.

42. The method as defined in claim 41 wherein the step of providing an audible alarm relay for momentarily activating an audible alarm comprises the more specific step of momentarily activating a horn within the water craft.

43. A water craft which includes a system which is remotely actuable via a radio frequency signal, and wherein said system includes the ability to clear fumes from an engine compartment without having to enter the boat, said system comprising:

a bilge blower;

a power supply;

a physically remote signalling device which is not physically coupled to the system, and which is capable of transmitting via at least one radio frequency an activation/deactivation toggling signal to the system; and a remotely activated switch electrically disposed between the bilge blower and the power supply and having a remote signalling receiver responsive to the activation/deactivation toggling signal transmitted via the at least one radio frequency from the physically remote signalling device to thereby electrically couple the bilge blower to the power supply so that the bilge blower clears the engine compartment of fumes after receiving said activation/deactivation toggling signal, and for electrically decoupling the bilge blower from the power supply after receiving a subsequent activation/deactivation toggling signal.

* * * * *